US007791544B2

(12) United States Patent
Kisselev et al.

(10) Patent No.: US 7,791,544 B2
(45) Date of Patent: Sep. 7, 2010

(54) BUILT-IN ANTENNA APPARATUS

(75) Inventors: Boris Kisselev, Suwon-si (KR); Dae-Hyun Sim, Seoul (KR); Tae-Sik Yang, Suwon-si (KR); Dong-Jun Lee, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 226 days.

(21) Appl. No.: 11/828,062

(22) Filed: Jul. 25, 2007

(65) Prior Publication Data

US 2008/0132272 A1 Jun. 5, 2008

(30) Foreign Application Priority Data

Dec. 1, 2006 (KR) ..... 10-2006-0121061

(51) Int. Cl.
*H01Q 1/24* (2006.01)

(52) U.S. Cl. ..... 343/702; 373/724; 455/552.1

(58) Field of Classification Search ..... 455/552.1; 333/254, 255; 343/906, 724; 439/700, 824
See application file for complete search history.

(56) References Cited

U.S. PATENT DOCUMENTS 5,092,774 A * 3/1992 Milan ..... 439/66
6,280,258 B1 * 8/2001 Frohlund ..... 439/700
6,417,807 B1 7/2002 Hsu et al.
2004/0201526 A1 10/2004 Knowles et al.
2004/0263420 A1 * 12/2004 Werner et al. ..... 343/909
2006/0222101 A1 * 10/2006 Cetiner et al. ..... 375/267

FOREIGN PATENT DOCUMENTS

JP 2005-244831 9/2005
JP 2006-279493 10/2006

* cited by examiner

*Primary Examiner*—Michael C Wimer
*Assistant Examiner*—Kyana R Robinson
(74) *Attorney, Agent, or Firm*—The Farrell Law Firm, LLP

(57) ABSTRACT

Disclosed is a built-in antenna apparatus comprising a plurality of antenna blocks, and an electrical connection device for connecting adjacent antenna blocks, the electrical connection device selectively connecting the antenna blocks so as to form varieties of the antenna. This enables the antenna blocks to be easily and detachably arranged according to the external shape, available mounting space and antenna characteristics of the mobile communications terminal.

4 Claims, 8 Drawing Sheets

BUILT-IN ANTENNA APPARATUS

PRIORITY

This application claims priority under 35 U.S.C. §119 to an application filed in the Korean Intellectual Property Office on Dec. 1, 2006 and assigned Serial No. 2006-121061, the contents of which are incorporated herein by reference.

BACKGROUND OF THE INVENTION

1. Field of the Invention

The present invention relates to a built-in antenna apparatus, and more particularly to a built-in antenna apparatus comprising a plurality of antenna blocks arranged so as to form varieties of the antenna.

2. Description of the Related Art

Nowadays, the mobile communications terminal is provided with multiple functions such as wireless link, digital broadcast reception, GPS (Global Positioning System) positioning, RFID (Radio Frequency Identification) and short distance communications.

In order to perform such multiple functions, the mobile communications terminal requires a particular antenna apparatus proper for each of the functions. The antenna apparatuses mounted in the mobile communications terminal are generally classified into two kinds according to the mounting position, i.e. the external antenna mounted outside the terminal housing, such as whip antenna and a helical antenna, and the internal antenna, such as an inverted F-type antenna, a planar inverted F-type antenna, a diversity antenna and a micro-strip antenna. The recent tendency of the mobile communications terminal toward miniaturization has led to the frequent use of the internal antenna apparatus.

Referring to FIG. 1, a conventional internal antenna apparatus comprises a patch antenna 3 having a length of about) $\lambda/4$ arranged above a PCB (Printed Circuit Board) 2 with a given gap between them, and a grounded pin 4 and current supply pin 5 arranged in the given gap.

Referring to FIG. 2, the patch antenna 3 may be the MRA (MEMS Reconfiguration Antenna) 3*a* mounted in a predetermined mounting space, which comprises a plurality of antenna pixels 3*b* and an RF (Radio Frequency) switch 3*c* between two adjacent antenna pixels 3*b*. The MRA 3*a* may serve as a multiple frequency band antenna for working at various frequency bands by means of the antenna pixels 3*b* selectively activated by turning on/off the RF switch 3*c*.

However, the conventional internal antenna using the MRA is made as a single unit integrally formed, and therefore, if the manufactured MRA antenna does not give desired properties, it must be reconstructed. Namely, there are no means of accommodating the antenna according to the antenna characteristics, the external shape of the mobile terminal and the available mounting space.

SUMMARY OF THE INVENTION

It is an aspect of the present invention to provide a built-in antenna apparatus including a plurality of antenna blocks arranged in various forms that may economize the available space for mounting the built-in antenna apparatus in a mobile communications terminal so as to slim and miniaturize the terminal with enhanced aesthetics.

It is another aspect of the present invention to provide a built-in antenna apparatus with improved performance by arranging in various forms antenna blocks made of a plurality of antenna pixels and a plurality of RF switches and other antenna blocks made of metal plates that may be selectively electrified according to the antenna characteristics used in a mobile communications terminal.

It is still another aspect of the present invention to provide a built-in antenna apparatus including a plurality of antenna blocks so arranged as to fit the external shape of a mobile communications terminal so that the available space for mounting the antenna apparatus may be economized with enhanced external aesthetics.

According to an aspect of the present invention, a built-in antenna apparatus a plurality of antenna blocks, and an electrical connection device for connecting adjacent antenna blocks, wherein the electrical connection device is used for selectively connecting the antenna blocks so as to form varieties of the antenna.

According to another aspect of the present invention, a built-in antenna apparatus includes a plurality of first antenna blocks, each first antenna block including a plurality of antenna pixels, and an RF switch for connecting adjacent antenna pixels, a plurality of second antenna blocks, each second antenna block including a single metal plate, and an electrical connection device attached to detachable connection surfaces of the antenna blocks, wherein the electrical connection device electrically connects adjacent first antenna blocks or adjacent second antenna blocks or adjacent first and second antenna blocks.

BRIEF DESCRIPTION OF THE DRAWINGS

The above and other aspects, features and advantages of the present invention will become more apparent from the following detailed description when taken in conjunction with the accompanying drawing in which.

DETAILED DESCRIPTION OF THE PREFERRED EMBODIMENT

Figure 1:
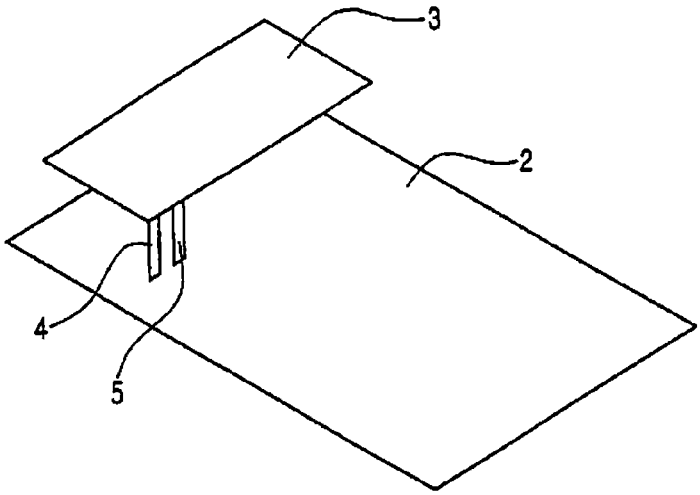
FIG.1 (PRIOR ART)
FIG. 1 is a perspective view for illustrating a conventional built-in antenna apparatus.
Figure 2:
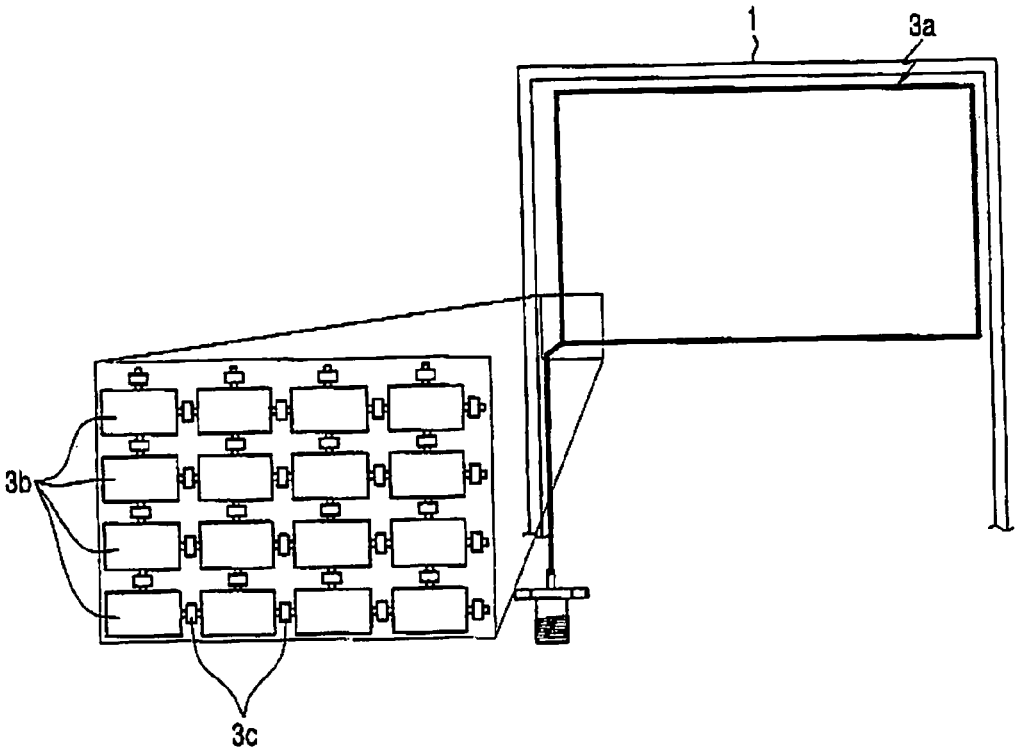
FIG.2 (PRIOR ART)
FIG. 2 is a schematic view for illustrating the structure of the MRA (MEMS Reconfiguration Antenna) used in a conventional built-in antenna apparatus.

Preferred embodiments of the present invention will be described herein below with reference to the accompanying drawings. In the drawings, the same or similar elements are denoted by the same reference numerals even though they are depicted in different drawings. In the following description, well-known functions or constructions are omitted for clarity and conciseness.

Figure 3:
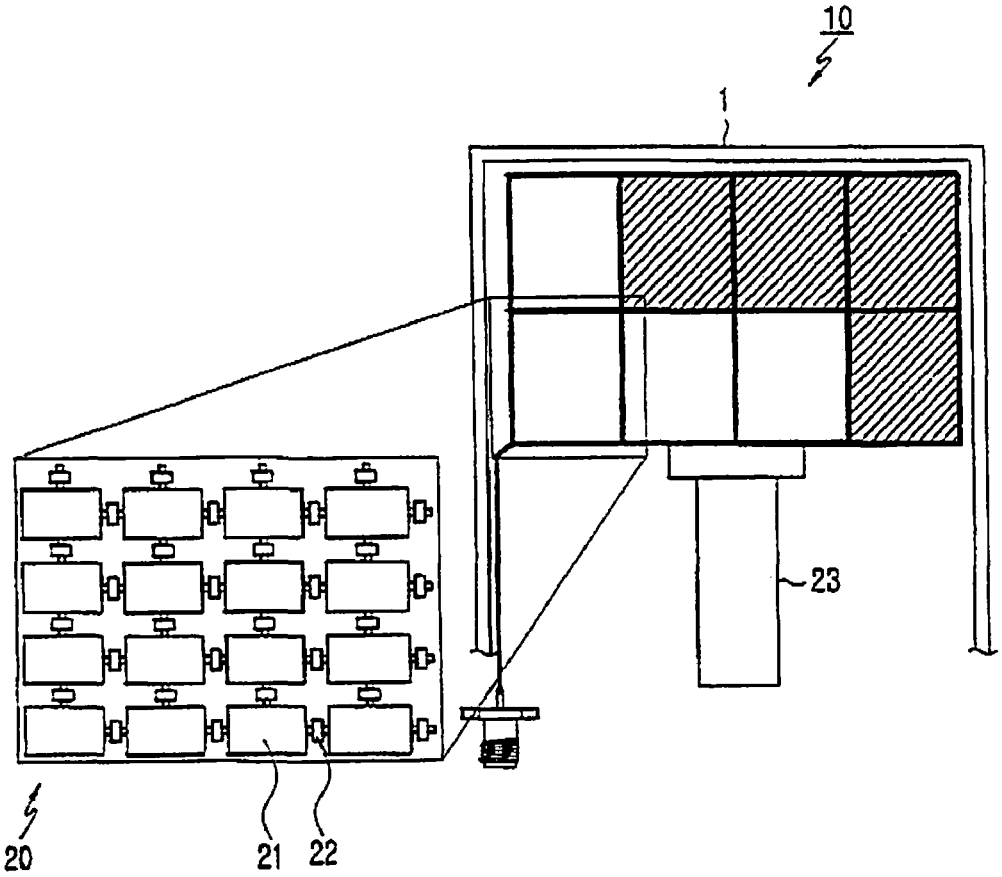
FIG. 3 is a schematic view for illustrating the structure of a built-in antenna apparatus according to a first embodiment of the present invention.
Figure 4:
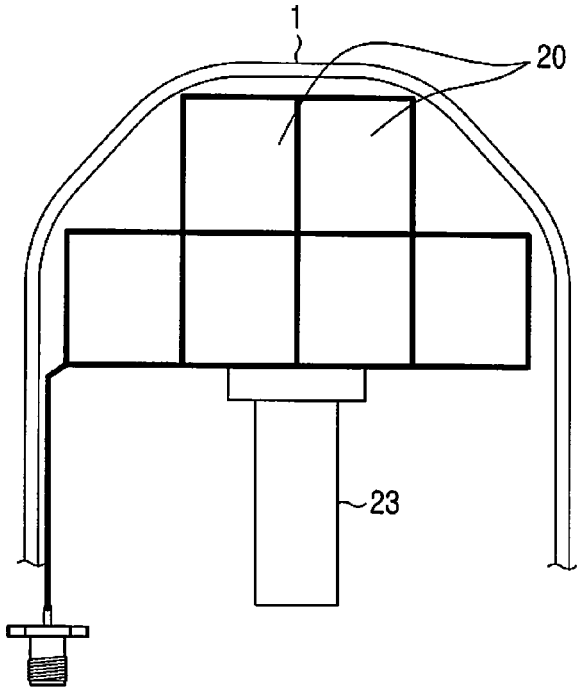
FIG. 4 is a schematic view for illustrating the internal space of a mobile communications terminal of a curved shape provided with a built-in antenna apparatus according to a first embodiment of the present invention.
Figure 5:
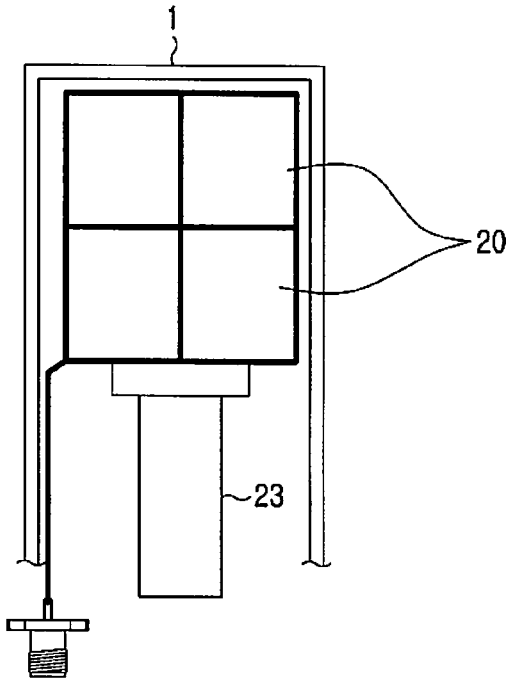
FIG. 5 is a schematic view for illustrating the internal space of a mobile communications terminal of a rectangular shape provided with a built-in antenna apparatus according to a first embodiment of the present invention.

Referring to FIG. 3, there is provided a built-in antenna apparatus 10 comprising a plurality of antenna blocks 20 interconnected. Each antenna block 20 comprises a plurality of antenna pixels 21 and a plurality of RF switches 22 mounted between adjacent antenna pixels 21. The interconnection of the plurality of antenna blocks 20 is accomplished by means of an electrical connection device 40, which will be hereinafter more specifically described. The antenna blocks may be freely and detachably interconnected into various forms according to the external shape, available mounting space and antenna characteristics of a mobile communications terminal, as shown in FIGS. 4 and 5. In addition, a cable 23 made of a flexible PCB (printed circuit board) is provided for applying a control signal to turn the RF switches 22 on/off so as to activate or deactivate the antenna pixels constituting each of the antenna blocks.

Figure 9:
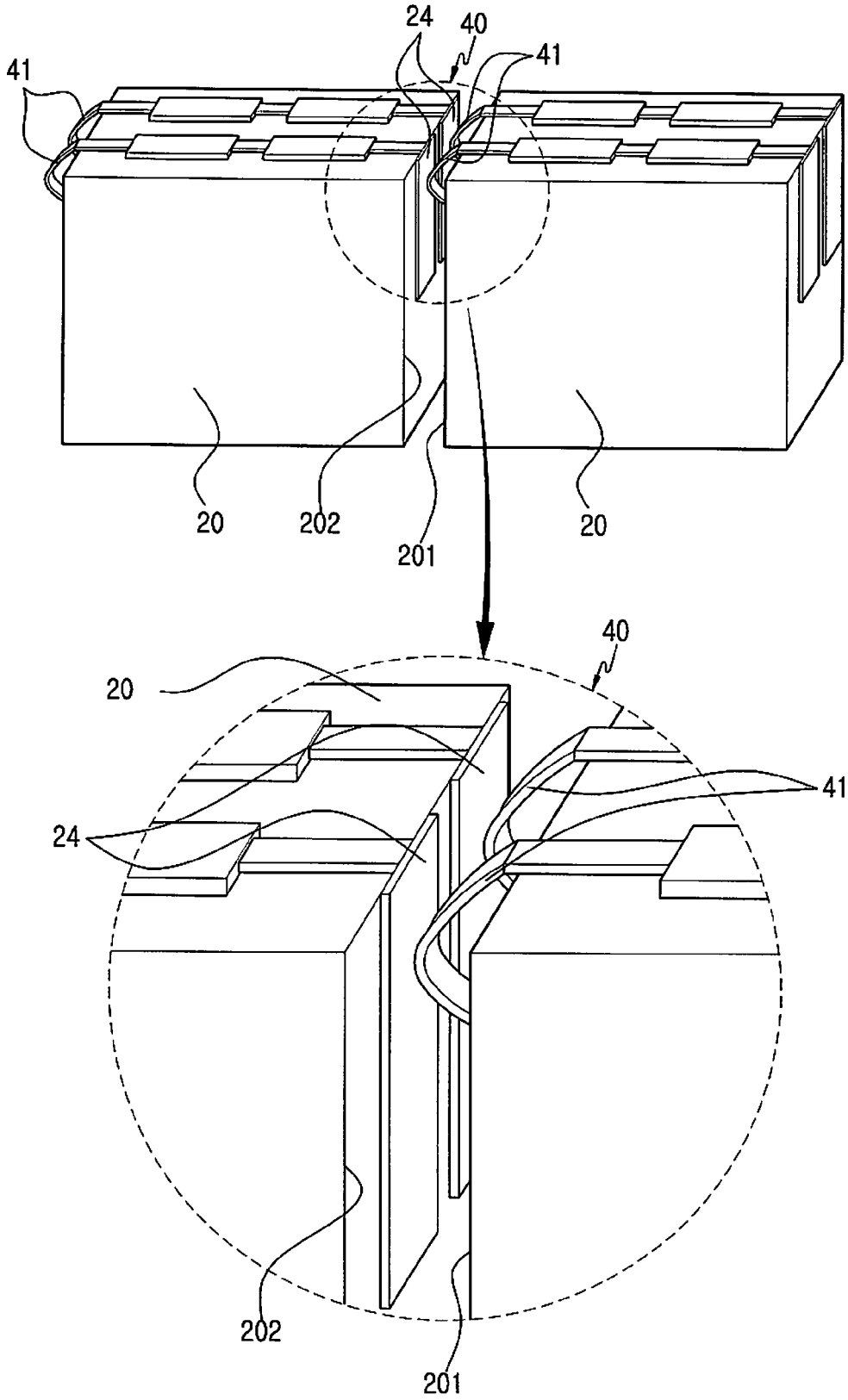
FIGS. 9 to 11 are views for illustrating examples of the electrical connections between the antenna blocks according to the present invention.
Figure 10:
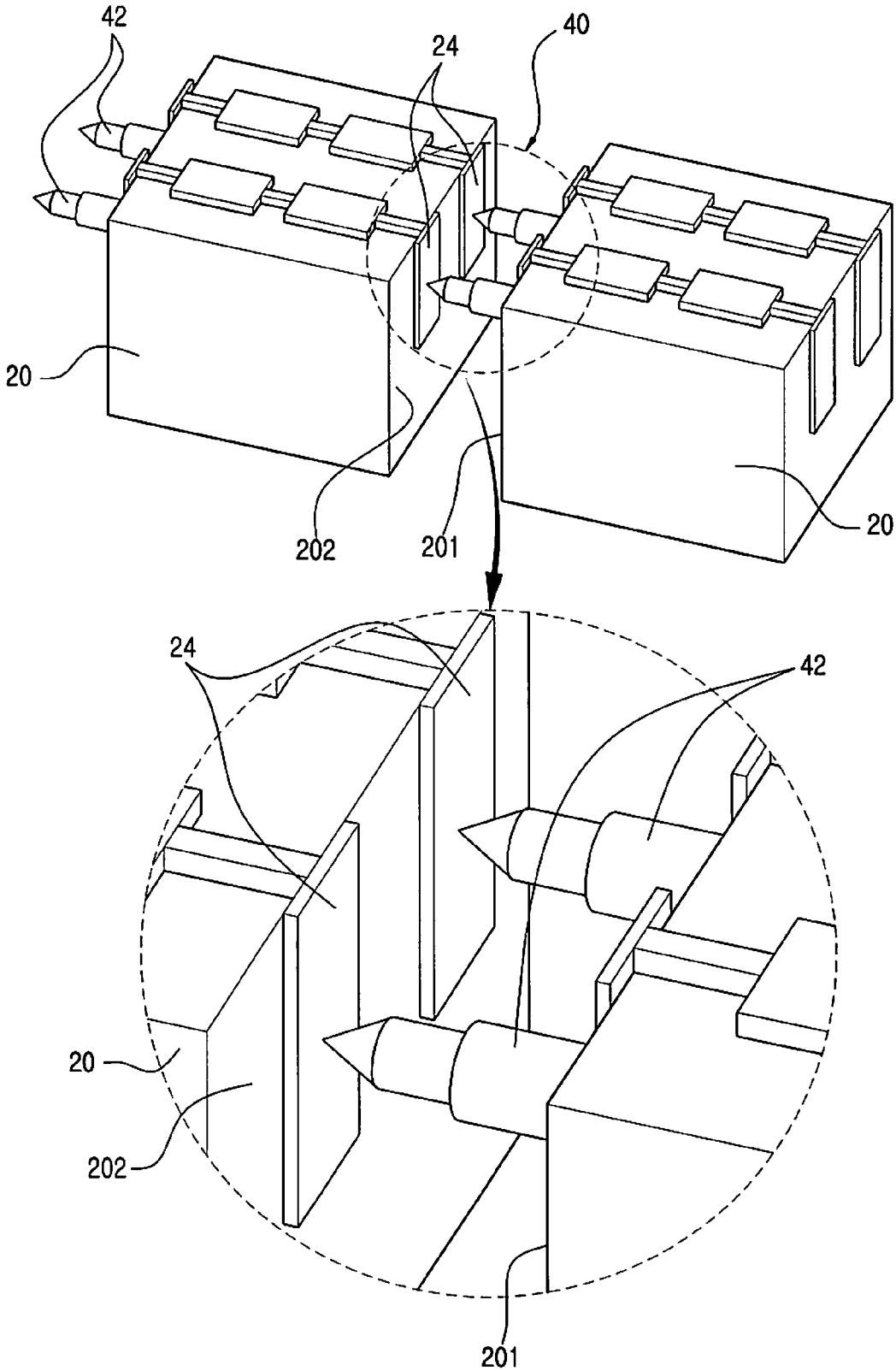

In a first embodiment of the invention, the electrical connection device 40 for interconnecting the antenna blocks 20 comprises reception parts 24 electrically and detachably connected to spring connectors 41 and 42, as shown in FIGS. 9 and 10. The spring connectors 41 and 42 are attached to a first detachable connection surface 201 of one of two adjacent antenna blocks 20, and the reception parts 24 to a second detachable connection surface 202 of the other of the two adjacent antenna blocks 20. The spring connectors 41 and 42 may be a plate spring 41 or pogo spring, as respectively shown in FIGS. 9 and 10.

Figure 11:
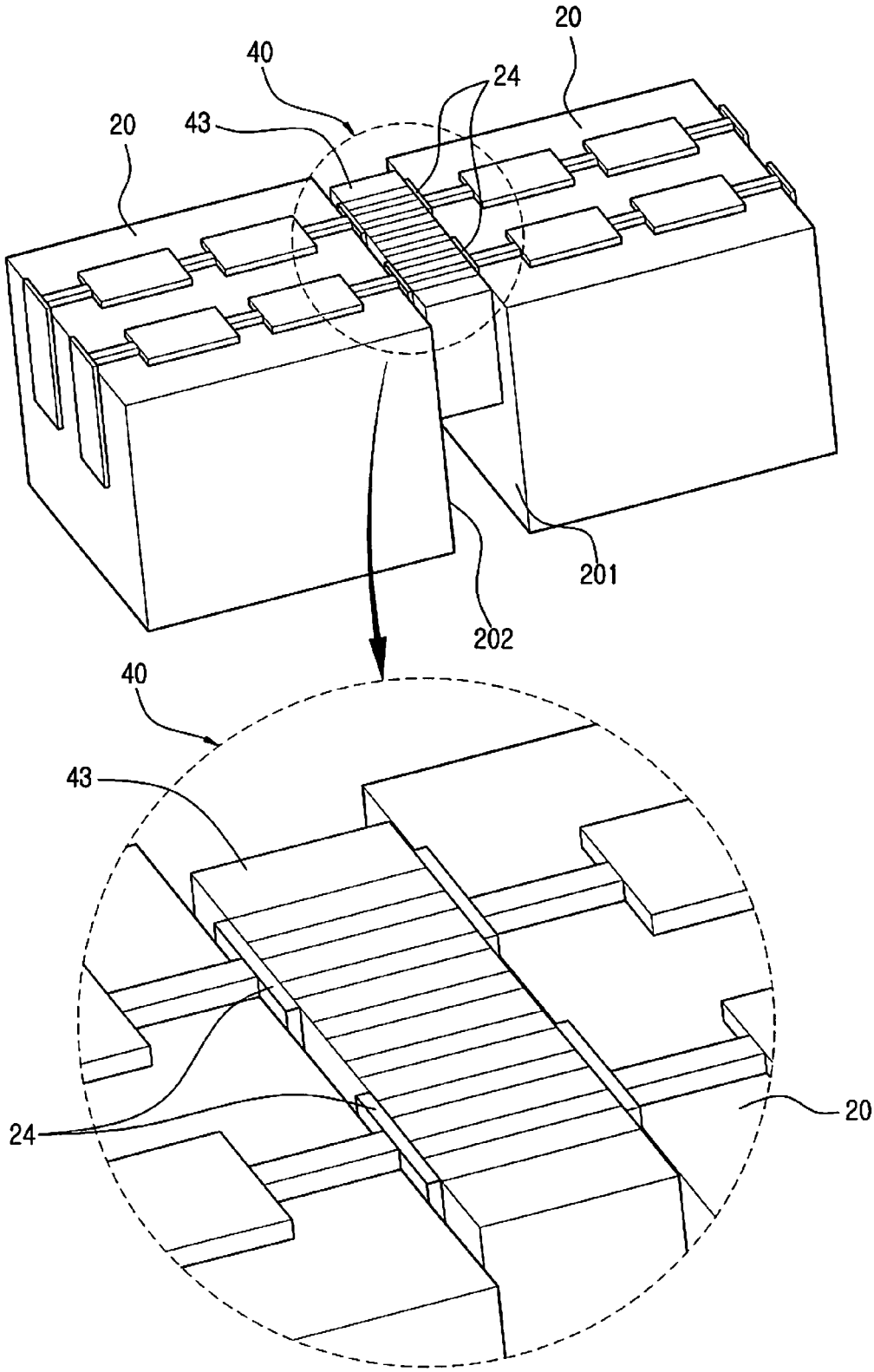

Alternatively, in another embodiment as shown in FIG. 11, the electrical connection device 40 comprises a conductive material 43 interconnecting reception parts 24 attached to both first and second detachable connection surfaces of adjacent antenna blocks 20. The conductive material 43 may comprise a conductive elastomer or polymer.

More specifically describing the construction and operation of the built-in antenna apparatus 10, if the external shape of a mobile communications terminal 1 is rectangular, the antenna blocks 20 are arranged in a rectangular form so that the spring connectors 41 and 42 attached to the first detachable connection surface 201 of one of adjacent antenna blocks 20 may contact the reception parts 24 attached to the second detachable connection surface 202 of the other so as to electrically connect the adjacent antenna blocks 20.

Meanwhile, the cable 23 provided in the antenna blocks 20 is connected to the control unit (not shown) of the mobile communications terminal 1 so that the control unit may send a control signal through the cable 23 to the antenna blocks according to the antenna characteristics determined by the signal characteristics of each of various radio communications signals stored in a memory (not shown). For example, the antenna arrangement of the built-in antenna apparatus 10 becomes different according to the antenna characteristics because the antenna pixels 21 are differently activated according to voice communication or DMB signals. Thus, the antenna pixels 21 of each antenna block are selectively activated or deactivated so as to establish the optimum radiation pattern according to the antenna characteristics. In this case, the antenna characteristics include resonance frequency, bandwidth, radiation type, gain, etc.

In this way, the built-in antenna apparatus 10 works to selectively activate the antenna pixels 21 so as to accommodate the antenna arrangement for the voice communication or DMB signals according to voice communication or DMB services. Moreover, as shown in FIGS. 4 and 5, the antenna blocks may be freely and selectively arranged so as to fit the external shape of the mobile terminal 1, e.g. curved or rectangular shape. This economizes the available mounting space for the built-in antenna apparatus so as to slim and miniaturize the mobile terminal together with enhanced aesthetics thereof.

Figure 6:
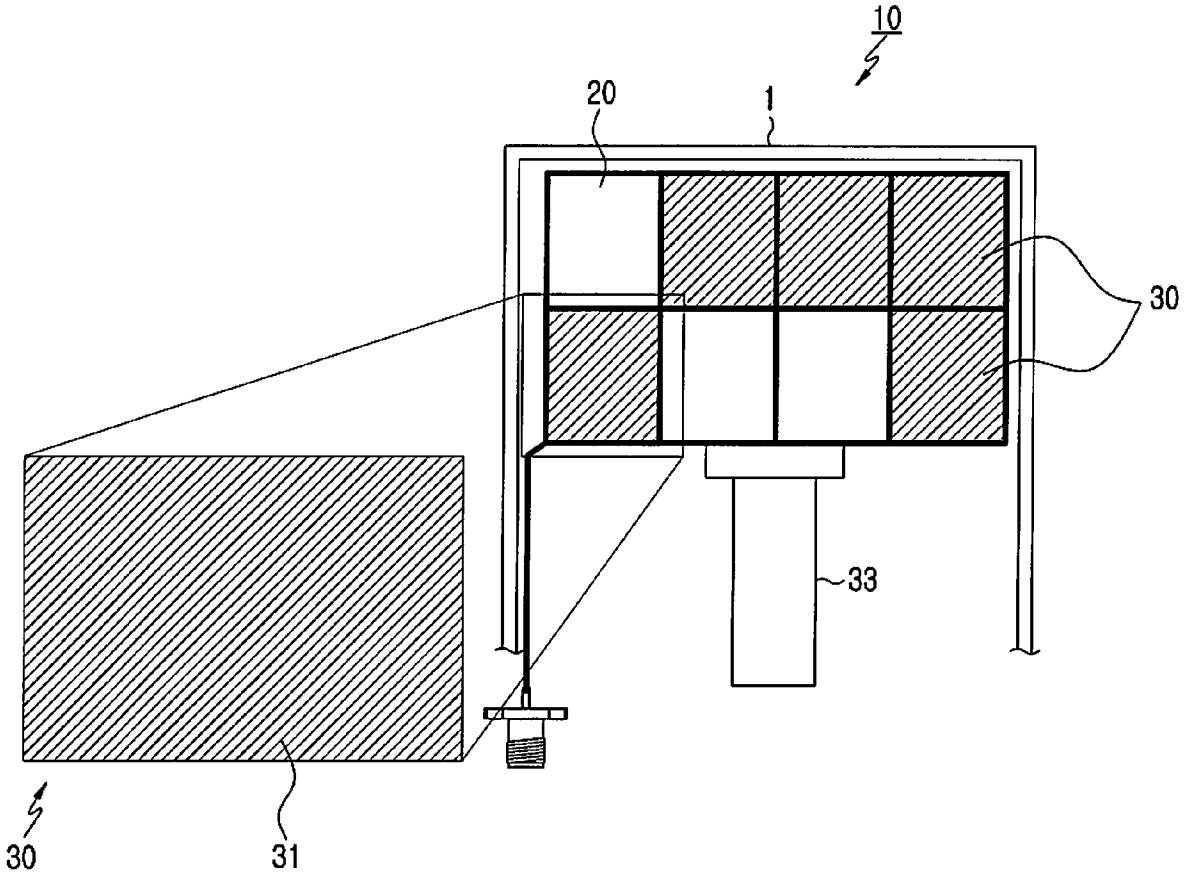
FIG. 6 is a schematic view for illustrating the structure of a built-in antenna apparatus according to a second embodiment of the present invention.
Figure 7:
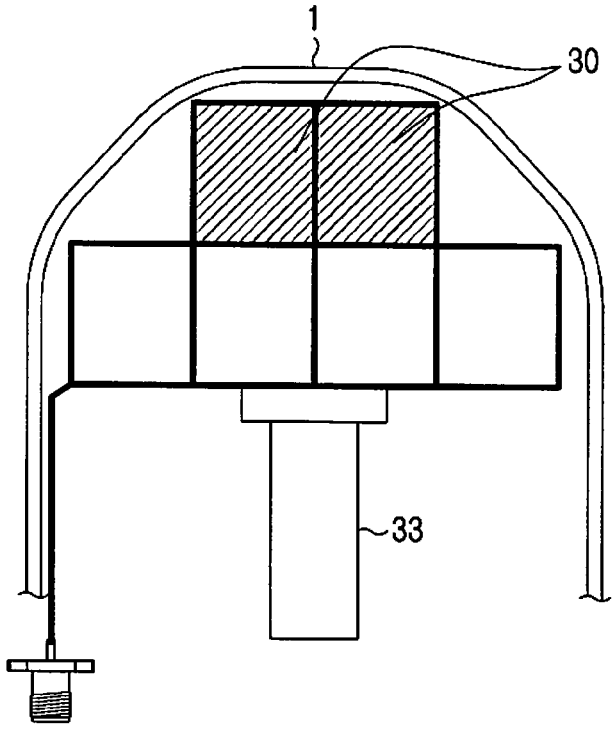
FIG. 7 is a schematic view for illustrating the internal space of a mobile communications terminal of a curved shape provided with a built-in antenna apparatus according to a second embodiment of the present invention.
Figure 8:
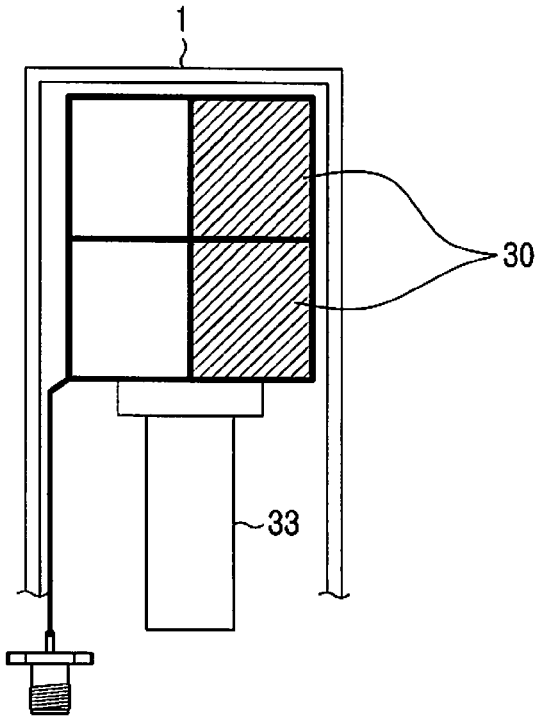
FIG. 8 is a schematic view for illustrating the internal space of a mobile communications terminal of a rectangular shape provided with a built-in antenna apparatus according to a first embodiment of the present invention.

Referring to FIGS. 6 to 8 for illustrating a second embodiment, a built-in antenna apparatus 10 comprises first and second antenna blocks 20 and 30, as shown in FIG. 6, wherein the first antenna block 20 comprises a plurality of antenna pixels 21 and an RF switch 22 mounted between two adjacent antenna pixels 21, and the second antenna block 30 as a single metal plate. Namely, the built-in antenna apparatus 10 may be obtained by various combinations of the first and second antenna blocks 20 and 30 electrically connected by an electrical connection device 40 similar to that connecting the antenna blocks 20 in the first embodiment. More specifically, the electrical connection device 40 may be commonly used for the antenna blocks 20 and 30, comprising reception parts 24 and spring connectors 41, 42. Of course, it may also include the reception parts 24 interconnected by conductive materials. Likewise, as shown in FIGS. 6 to 8, the antenna blocks 20 and 30 may be freely and detachably arranged into various forms according to the external shape of the mobile terminal, e.g. rectangular or curved shape. The electrical interconnection between all adjacent ones of the first and second antenna blocks 20 and 30 is accomplished by means of the electrical connection device.

While the invention has been shown and described with reference to a certain preferred embodiment thereof, it will be understood by those skilled in the art that various changes in form and details may be made therein without departing from the spirit and scope of the invention.

What is claimed is:

1. A built-in antenna apparatus of a mobile communication terminal, the built-in antenna apparatus comprising:

a plurality of antenna blocks; and an electrical connection device for selectively connecting adjacent antenna blocks, wherein different arrangements of the built-in antenna apparatus are provided by differently activating said electrical connection device, wherein each of said antenna blocks comprises a plurality of antenna pixels, and an RF switch connecting adjacent antenna pixels, wherein the electrical connection device includes spring connectors attached to a first detachable connection surface of one of two adjacent antenna blocks, and includes reception parts attached to a second detachable connection surface of an other of the two adjacent antenna blocks, wherein each spring connector is connected to one reception part so as to electrically connect the adjacent antenna blocks, and wherein the spring connector is made of one of a plate spring and a pogo spring.

2. The built-in antenna apparatus of claim 1, wherein each of said antenna blocks comprises a metal plate.

3. The built-in antenna apparatus of claim 1, wherein the differently activating of the electrical connection device is performed according to whether the mobile terminal is performing voice communication or digital multimedia broadcasting.

4. A built-in antenna apparatus of a mobile communication terminal, the built-in apparatus comprising: a plurality of antenna blocks; and an electrical connection device for selectively connecting adjacent antenna blocks, wherein different arrangements of the built-in antenna apparatus are provided by differently activating said electrical device, wherein each of said antenna blocks comprises a plurality of antenna pixels, and an RF switch connecting adjacent pixels, wherein said electrical connection device comprises: reception parts respectively attached to a first detachable connection surface of one of the adjacent antenna blocks and to a second detachable connection surface of an other of the adjacent antenna blocks; and a conductive material inserted between the adjacent antenna blocks for contacting said reception part so as to electrically connect the adjacent antenna blocks, wherein said conductive material is one of a conductive polymer and a conductive elastomer.

* * * * *